US006133820A

United States Patent [19]

Duggal et al.

[11] Patent Number: 6,133,820

[45] Date of Patent: Oct. 17, 2000

[54] CURRENT LIMITING DEVICE HAVING A WEB STRUCTURE

[75] Inventors: Anil Raj Duggal; Minyoung Lee, both of Niskayuna; Siegfried Aftergut, Schenectady, all of N.Y.

[73] Assignee: General Electric Company, Schenectady, N.Y.

[21] Appl. No.: 09/133,159

[22] Filed: Aug. 12, 1998

[51] Int. Cl.[7] ..... H01C 7/13

[52] U.S. Cl. ..... 338/22 R; 338/99; 338/114

[58] Field of Search ..... 338/22 R, 225 D, 338/23, 24, 20, 21, 99, 104, 114

[56] References Cited

U.S. PATENT DOCUMENTS

| | | | |
|---|---|---|---|
| 3,138,686 | 6/1964 | Mitoff et al. | 338/22 R |
| 3,226,600 | 12/1965 | Zielasek . | |
| 3,243,753 | 3/1966 | Kohler . | |
| 3,648,002 | 3/1972 | DuRocher . | |
| 3,673,121 | 6/1972 | Meyer . | |
| 3,775,452 | 11/1973 | Karstedt . | |
| 4,017,715 | 4/1977 | Whitney et al. . | |
| 4,101,862 | 7/1978 | Takagi et al. . | |
| 4,107,640 | 8/1978 | Asano et al. . | |
| 4,223,209 | 9/1980 | Diaz | 338/22 R |
| 4,237,441 | 12/1980 | van Konynenburg et al. . | |
| 4,292,261 | 9/1981 | Kotani et al. . | |
| 4,304,987 | 12/1981 | van Konynenburg . | |
| 4,314,230 | 2/1982 | Cardinal et al. | 338/314 |
| 4,317,027 | 2/1982 | Middleman et al. . | |
| 4,330,704 | 5/1982 | Jensen | 338/22 R |
| 4,414,052 | 11/1983 | Habata et al. | 338/22 R |
| 4,583,146 | 4/1986 | Howell . | |
| 4,685,025 | 8/1987 | Carlomagno . | |
| 4,727,134 | 2/1988 | Brunelle et al. . | |
| 4,890,186 | 12/1989 | Matsubara et al. . | |

(List continued on next page.)

FOREIGN PATENT DOCUMENTS

| | | |
|---|---|---|
| 0640995 | 3/1995 | European Pat. Off. . |
| 0713227 | 5/1996 | European Pat. Off. . |
| 0747910 | 12/1996 | European Pat. Off. . |
| 4330607 | 3/1995 | Germany . |
| 9112643 | 8/1991 | WIPO . |
| 9119297 | 12/1991 | WIPO . |
| 9321677 | 10/1993 | WIPO . |
| 9410734 | 5/1994 | WIPO . |
| 9534931 | 12/1995 | WIPO . |
| 9602922 | 2/1996 | WIPO . |
| 9749102 | 12/1997 | WIPO . |

OTHER PUBLICATIONS

U.S. application No. 08/896,874, filed Jul. 21, 1997, Current Limiting Device With Electrically Conductive Composite and Method of Manufacturing the Electrically Conductive Composite.

(List continued on next page.)

*Primary Examiner*—Karl D. Easthom

*Attorney, Agent, or Firm*—Tyler Maddry; Noreen C. Johnson

[57] ABSTRACT

An exemplary current limiting device comprises first and second electrodes; a composite material between the first and second electrodes, the composite material comprising: (a) a binder, and (b) an electrically conductive filler; a thin layer which provides an inhomogeneous distribution of resistance to the device; a web which reinforces the composite material; and a pressurizer for pressing the electrodes against the composite material; wherein the web is disposed in a volume of the composite material which does not include the thin layer. The current limiting device is simple and reusable, and can be tailored to a plurality of applications, including high voltage/current distribution systems, to protect sensitive components from high fault currents. The device has a robust structure which allows it to repeatedly withstand the high mechanical and thermal stresses which typically accompany switching events in high voltage/current circuits. The robust structure improves the lifetime of the device and provides impact resistance to the device. The device operates without relying on the PTCR effect to limit current.

31 Claims, 2 Drawing Sheets

U.S. PATENT DOCUMENTS

| | | | |
|---|---|---|---|
| 5,039,783 | 8/1991 | Brunelle et al. . | |
| 5,057,674 | 10/1991 | Smith-Johannsen . | |
| 5,068,634 | 11/1991 | Shrier . | |
| 5,166,658 | 11/1992 | Fang et al. . | |
| 5,247,276 | 9/1993 | Yamazaki . | |
| 5,260,848 | 11/1993 | Childers . | |
| 5,313,184 | 5/1994 | Greuter et al. . | |
| 5,331,318 | 7/1944 | Montgomery . | |
| 5,362,845 | 11/1994 | Takekoshi et al. . | |
| 5,382,938 | 1/1995 | Hansson et al. | 338/22 R |
| 5,393,597 | 2/1995 | Childers et al. | 338/20 |
| 5,414,403 | 5/1995 | Greuter et al. . | |
| 5,416,462 | 5/1995 | Demarmels et al. . | |
| 5,432,140 | 7/1995 | Sumpter et al. . | |
| 5,432,666 | 7/1995 | Hodge . | |
| 5,436,274 | 7/1995 | Sumpter et al. . | |
| 5,451,919 | 9/1995 | Chu et al. . | |
| 5,545,679 | 8/1996 | Bollinger, Jr. et al. . | |
| 5,581,192 | 12/1996 | Shea et al. . | |
| 5,602,520 | 2/1997 | Baiatu et al. . | |
| 5,614,881 | 3/1997 | Duggal et al. . | |
| 5,629,584 | 5/1997 | Borowiec et al. . | |
| 5,644,283 | 7/1997 | Grosse-Wilde et al. . | |
| 5,777,541 | 7/1998 | Vekeman . | |
| 5,828,289 | 10/1998 | Burgess | 338/99 |
| 5,896,264 | 4/1999 | Bijlenga et al. | 338/22 R |

OTHER PUBLICATIONS

U.S. application No. 08/925,011, filed Aug. 28, 1997, Current Limiting Device With Electrically Conductive Composite Material Structure and Method of Manufacturing the Electrically Conductive Composite Material Structure and Current Limiting Device.

U.S. application No. 08/949,784, filed Oct. 10, 1997, Current Limiting Device (Reissue Application of U.S. Patent No. 5,614,881).

U.S. application No. 08/977,672, filed Nov. 24, 1997, Current Limiting Device With Conductive Composite Material and Method of Manufacturing the Conductive Composite Material and the Current Limiting Device.

U.S. application No. 09/081,888, filed May 20, 1998, Current Limiting Device and Materials For a Current Limiting Device.

Anil Duggal and Lionel Levinson, A Novel High Current Density Switching Effect in Electrically Conductive Polymer Composite Materials, 82 J. Appl. Phys. 5532 (Dec. 1997).

Anil Duggal and F.G. Sun, The Initiation of High Current Density Switching in Electrically Conductive Polymer Composite Materials, 83 J. Appl. Phys. 2046 (Feb. 15, 1998).

Anil Duggal and Lionel Levinson, High Power Switching Behavior in Electrically Conductive Polymer Composite Materials, 71 Appl. Phys. Lett. 1939 (Oct. 1997).

*Epoxy Resins; Chemistry and Technology*, 896–902 (Clayton A. May, ed., 1988).

R. Shrout et al., *Composite PTCR Thermistors Utilizing Conducting Borides, Silicides, and Carbide Powders*, 145–154 (1991).

G.R. Ruschau et al., *Resistivities of Conductive Composites*, 72 J. Appl. Phys. 953 (1992).

Ralf Strumpler, *Polymer Composite Thermistors for Temperature and Current Sensors*, 80 J. Appl. Phys. 6091 (1996).

Henry Lee and Kris Neville, *Epoxy Resins, Their Applications and Technology*, 233–249 (1957).

G.M. Tsangaris et al., *Conductivity and Percolation in Polymeric Particulate Composites of Epoxy Resin and Conductive Fillers*, 430 IEE Conf. Publ. 100–102 (1996).

CURRENT LIMITING DEVICE HAVING A WEB STRUCTURE

BACKGROUND

1. Field of the Invention

This invention relates generally to devices for general circuit protection including electrical distribution and motor control applications, more particularly to simple, reusable, potentially low cost devices that can be tailored to a plurality of applications, and most particularly to current limiting devices for relatively high power applications where the system voltage is equal to or greater than 100V and the short-circuit current is equal to or greater than 100 A utilizing an electrically conductive composite material and an inhomogeneous distribution of resistance structure.

2. Description of the Related Art

There are numerous devices that are capable of limiting the current in a circuit when a short-circuit occurs. One current limiting device presently being used includes a filled polymer material which exhibits what is commonly referred to as a positive-temperature coefficient of resistance ("PTCR" or "PTC") effect. The unique attribute of the PTCR effect is that at a certain switch temperature the PTCR material undergoes a transformation from a more conducting material to a more resistive material. In some of these prior current limiting devices, the PTCR material, typically polyethylene loaded with carbon black, is placed between pressure contact electrodes.

In operation, these prior current limiting devices are placed in the circuit to be protected. Under normal circuit conditions, the current limiting device is in a highly conducting state. When a short-circuit occurs, the PTCR material heats up through resistive heating until the temperature is above the switch temperature. At this point, the PTCR material resistance changes to a high resistance state and the short-circuit current is limited. When the short-circuit is cleared, the current limiting device cools down to below the switch temperature and returns to the highly conducting state. In the highly conducting state, the current limiting device is again capable of switching to the high resistance state in response to future short-circuit events. Examples of patents which disclose PTCR materials include U.S. Pat. Nos. 5,382,938 and 5,313,184, and European Patent No. 0 640 995 A1.

Current limiting devices based on the PTCR effect are typically designed for low power circuit applications, e.g., for a maximum current density of less than 10 A/cm$^2$. Other current limiting devices are known for higher power applications. For example, commonly-owned U.S. Pat. No. 5,614,881 to Duggal et al. discloses a current limiting device comprising an electrically conductive composite material which includes an electrically conductive filler, two electrodes positioned adjacent to the composite material, an inhomogeneous distribution of resistance structure, and means for exerting compressive pressure on the electrically conductive composite material. In this device, the composite material does not rely on the PTCR effect to limit the current during a switching event.

The current limiting device described in the Duggal U.S. Pat. No. 5,614,881 is believed to effectively limit the current during a switching event by resistive heating of a high resistance thin layer followed by rapid thermal expansion and gas evolution from the binding material, which leads to a partial or complete physical separation of the current limiting device. The separation produces a higher overall device resistance to electric current flow which limits the flow of current through the short-circuited current path.

Although the current limiting device described in the Duggal U.S. Pat. No. 5,614,881 operates effectively to limit current, a high power switching event typically produces large mechanical stresses on the current limiting material. Thus, an advantageous feature of such a current limiting device is the ability to repeatedly withstand the high stresses caused by multiple high power switching events.

SUMMARY

A current limiting device, according to an exemplary embodiment of the invention, comprises first and second electrodes; a composite material between the first and second electrodes, the composite material comprising: (a) a binder, and (b) an electrically conductive filler; a thin layer which provides an inhomogeneous distribution of resistance to the device; a web which reinforces the composite material; and a pressurizer for pressing the electrodes against the composite material, wherein the web is disposed in a volume of the composite material which does not include the thin layer.

According to another embodiment, the current limiting device comprises first and second electrodes; a composite material between the first and second electrodes, the composite material comprising: (a) a binder, and (b) an electrically conductive filler; a web disposed in the composite material, the web being formed of an electrically insulative material; a thin layer which provides an inhomogeneous distribution of resistance to the device; and a pressurizer for pressing the electrodes against the composite material.

According to a further embodiment, the current limiting device comprises first and second electrodes; a composite material between the first and second electrodes, the composite material being in the form of a web, the composite material comprising: (a) a binder, and (b) an electrically conductive filler; a compressible material which occupies spaces within the web; and a pressurizer for pressing the electrodes against the composite material.

Exemplary embodiments of the invention provide a simple, reusable current limiting device that can be tailored to a plurality of applications, including high voltage/current distribution systems, to protect sensitive components from high fault currents. The device has a robust structure which allows it to repeatedly withstand the high mechanical and thermal stresses which often accompany switching events in high voltage/current circuits. The robust structure improves the lifetime of the device and provides impact resistance to the device. The device can operate without relying on the PTCR effect to limit current.

BRIEF DESCRIPTION OF THE DRAWINGS

Other features and advantages of the invention will be apparent from the following detailed description and the accompanying drawings, in which.

DETAILED DESCRIPTION OF THE PREFERRED EMBODIMENTS

A current limiting device, according to exemplary embodiments of the invention, includes a composite material comprising a low pyrolysis or vaporization temperature binder and an electrically conductive filler. The current limiting device may also comprise a reinforcing web or mesh, or the composite material may be in the form of a web or mesh. The binder is typically chosen such that significant gas evolution occurs at a low pyrolysis or vaporization temperature, e.g., less than 800° C., typically less than 400° C. The conductive filler may comprise an electrically conductive material such as silver, nickel, aluminum, titanium boride, graphite, or carbon black, for example. The device preferably includes at least one selected thin layer which has a higher resistance than the resistance of an average layer of the same thickness and orientation of the current limiting device, and thus provides an inhomogeneous distribution of resistance to the device. The thin layer typically includes a portion of the composite material.

It is believed that the advantageous results of the invention are obtained because, during a short-circuit event, resistive heating of this selected thin layer, which may be adiabatic, followed by rapid thermal expansion and gas evolution from the binding material, leads to a partial or complete physical separation of the current limiting device at the selected thin layer which produces a higher over-all device resistance to electric current flow. Thus, the current limiting device limits the flow of current through the short-circuited current path. When the short-circuit is cleared, e.g. by external means, it is believed that the current limiting device regains its low resistance state due to the compressive pressure built into the current limiting device, allowing electrical current to flow normally. The current limiting device is reusable for many such short circuit conditions, depending upon such factors, among others, as the severity and duration of each short circuit event.

Figure 1:
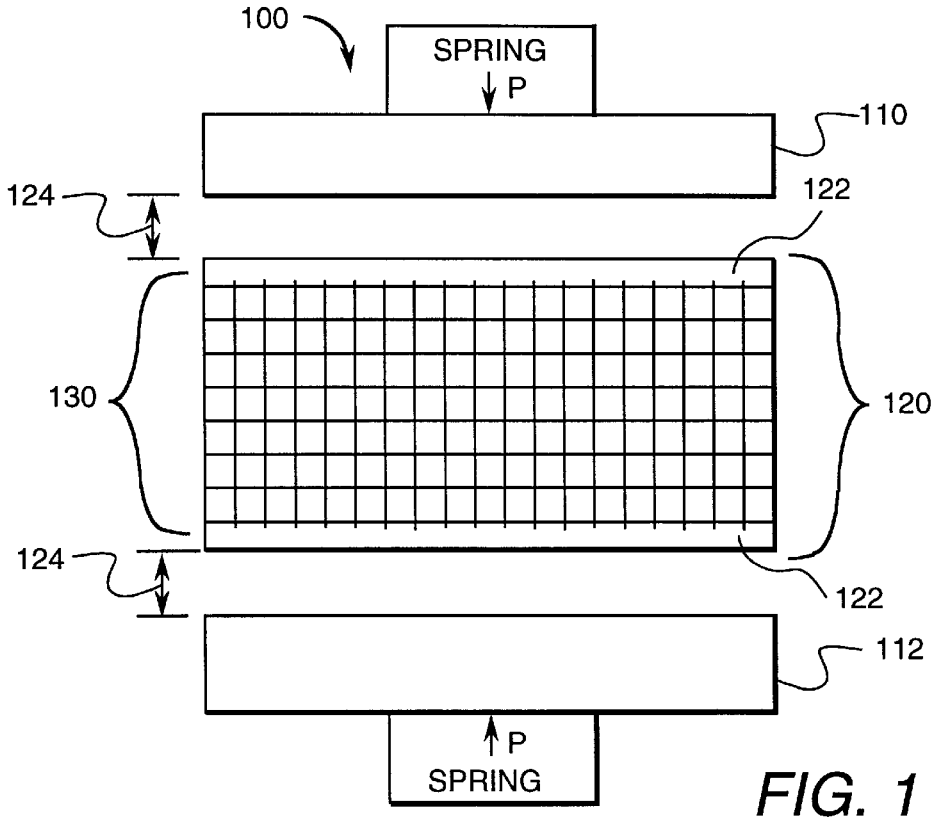
FIG. 1 illustrates a current limiting device according to a first embodiment of the invention.

A first embodiment of the invention is shown in FIG. 1. The current limiting device 100 includes first and second electrodes 110, 112 and an electrically conductive composite material 120 positioned between the electrodes. For clarity, the current limiting device in FIGS. 1–4 is shown in an exploded view. The composite material 120 includes an electrically conductive filler and a binder having a low pyrolysis or vaporization temperature. Examples of materials which can be used to form the composite material 120 are described below.

As described in U.S. Pat. No. 5,614,881, which is hereby incorporated by reference in its entirety, the current limiting device is formed to have an inhomogeneous distribution of resistance structure. The inhomogeneous distribution of resistance is typically provided by at least one thin layer of the current limiting device which is positioned perpendicular to the direction of current flow and has a higher resistance than the average resistance for an average layer of the same thickness and orientation in the device.

Figure 4:
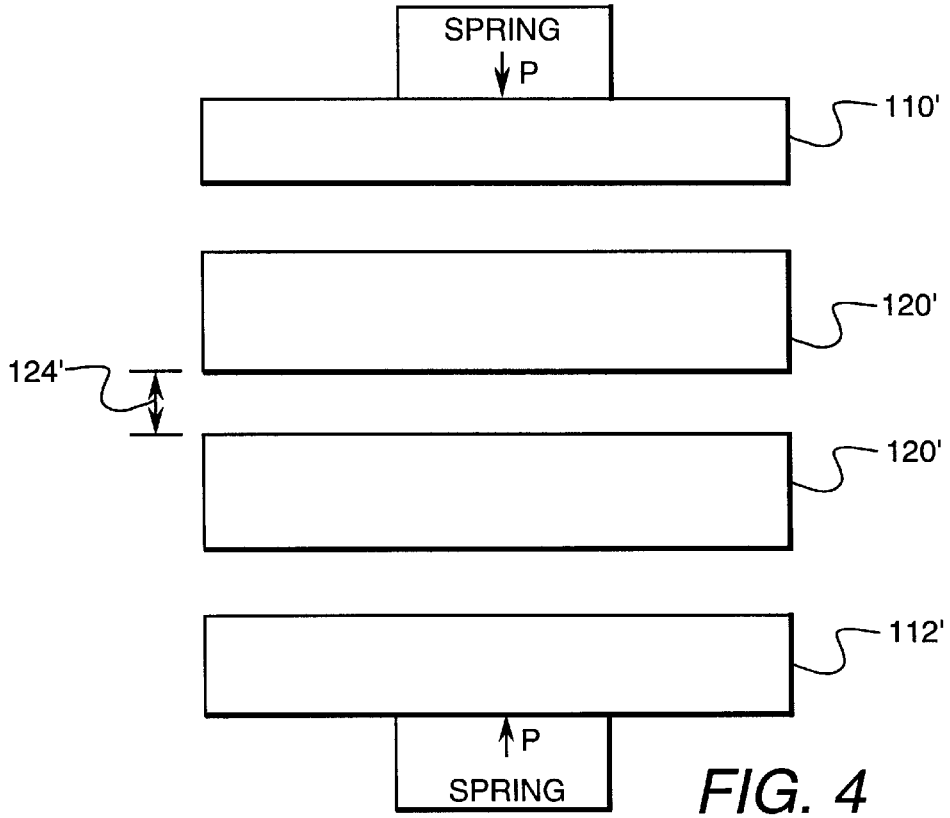
FIG. 4 illustrates a current limiting device according to a fourth embodiment of the invention in which the composite material is formed in two halves.

As shown in FIG. 1, the thin layer 124 may be a layer which includes opposing surfaces of the composite material 120 and one of the electrodes 110, 112, wherein the higher resistance derives from the contact resistance between the electrode and composite material. "Contact resistance" refers to the resistance which results from the juxtaposition of two surfaces which have a certain degree of roughness. According to other embodiments of the invention, the thin layer is formed in a central region of the composite material, for example by pressing together two half pieces of the composite material. FIG. 4 illustrates such an embodiment having a thin layer 124'. The contact resistance between the surfaces of the two half pieces 120' provides the increased resistance thin layer 124'. As will be recognized by those skilled in the art, the thin layer can be located anywhere between the electrodes. Those skilled in the art will also recognize that the present invention is not limited to the single composite material, two electrode version shown in FIG. 1, but can include multiple composite materials and more than two electrodes.

The thin layer typically has a thickness of about 10–200 $\mu$m, regardless of the total thickness of the composite material 120, and exhibits a resistance that is typically at least about 10% greater than the resistance of an average layer of the same thickness and orientation in the device. Alterative ways of creating the higher resistance thin layer 124 include: providing a lower number of conductive filler particles in the thin layer that carry electric current; roughening the composite material or the electrode or both at their interface so that only a subset of the conductive filler particles that would normally carry current are utilized; reducing the cross-sectional area of the composite material perpendicular to the current flow in a selected region, and placing a layer of non-conducting material (e.g. <1 $\mu$m, typically <100 nm) between the electrode and composite material or between the two halves of composite material 120' in FIG. 4.

Referring again to FIG. 1, the current limiting device is preferably under compressive pressure in a direction perpendicular to the selected thin high resistance layer 124, as indicated by the arrows labeled "P". The composite material 120 is typically pressure contacted to the electrodes so that there is a contact resistance between the composite material 120 and one or both electrodes 110, 112. In operation, the device 100 is placed in series with the electrical circuit to be protected. The pressure may be provided by any conventional compressible device or pressurizer such as a mechanical spring, a gas spring, a pneumatic spring, etc.

As shown in FIG. 1, the current limiting device 100 also includes a reinforcing web 130 which is disposed within the composite material 120. The web 130 typically takes the form of a three-dimensional network of connected, continuous strands. The strands of the web 130 may comprise a metal such as nickel, aluminum, silver, or copper, for example. The strands of the web 130 may also comprise glass, fiberglass, nylon, polyester, graphite fibers, boron fibers, cotton, modified cotton, rayon, cellulose, a cellulose derivative, an acrylic, polycarbonate, polyurethane, or a polyaramid (KEVLAR). Preferably, the web 130 comprises a material which is compatible with the composite material 120, and which is stable at temperatures encountered during a switching event.

The strands of the web 130 typically are connected to one another at a plurality of nodes to form a network structure which provides strength to the composite material 120. The network structure may have a regular pore structure between strands. One example of a web which can be used is INCOFOAM nickel foam, available from Inco Corp. in Sudbury, Ontario, Canada. Webs made of the other materials described above (e.g. glass, fiberglass, nylon, etc.) are commercially available in a wide variety of strand diameters and opening sizes. In FIG. 1, the size and configuration of the web 130 relative to the size of the composite material 120 is provided as one example. However, those skilled in the art will readily appreciate that other configurations are possible.

The web 130 may also be generally in the form of a two-dimensional mesh, if desired. By "two-dimensional" is meant that the mesh occupies a plane and has a small, non-zero thickness. The two-dimensional mesh can be located within the composite material parallel to the electrodes, for example. The current limiting device can be formed by laminating the two-dimensional mesh between two pieces of composite material. Of course, a plurality of layers of mesh at different locations in the composite material can be used for enhanced strength.

The web 130 provides reinforcement to the composite material 120 to prevent cracking or breaking of the composite material 120 during a switching event, in which a substantial amount of energy is typically directed to the composite material 120. The web 130, according to this embodiment, occupies a partial volume of the composite material 120 such that it does not occupy the thin layer 124 of higher resistance, e.g., the region in the composite material 120 adjacent to the electrodes 110, 112. The composite material 120 thus includes at least one web-free region 122, as shown in FIG. 1, which typically coincides with the thin layer 124. The web-free region 122 in the composite material 120 allows the composite material 120 to reform into its nonseparated state after a switching event, due to the pressure "P" applied to the electrodes, without any physical interference from the web 130. The web 130 can thus be formed of a rugged material such as copper or nickel, which does not ablate during a switching event, for enhanced strength.

During normal operation, the resistance of the current limiting device 100 is low. In this example, the resistance of the current limiting device 100 would be equal to the resistance of the composite material 120 and web 130 plus the resistance of the electrodes 110, 112 plus the contact resistance between the composite material and the electrodes. When a short-circuit occurs, a high current density starts to flow through the device 100. In the initial stages of the short-circuit, the resistive heating of the device may be adiabatic. Thus, it is believed that the selected thin, more resistive layer 124 of the current limiting device 100 (e.g. the layer of composite material adjacent to the electrode) heats up much faster than the rest of the current limiting device. The resistive heating is followed by rapid thermal expansion and gas evolution from the composite material.

The thermal expansion and gas evolution lead to a partial or complete separation at the thin layer 124, e.g. between the electrode and the composite material. Parts of the composite material 120 in the thin layer 124 ablate and produce gas products. The gas products cause separations within the thin layer 124. The separations produce gaps in the thin layer 124 and a higher switched resistance. The result of these separations is reduced electrical connectivity at the thin layer 124. For example, conductive particles of the conductive filler material may be separated from one another, reducing electrical connectivity of conductive particles in the thin layer and increasing the resistance of the thin layer.

In this separated state, it is believed that ablation of the composite material 120 occurs, and arcing between the separated layers of the current limiting device can occur. The overall resistance of the device in the separated state is typically much higher than in the nonseparated state. The ratio of the switched resistance to the initial resistance may be, for example, from 10 to 1000 or more. The high arc resistance is believed to be due to the high pressure generated at the thin layer 124 by the gas evolution from the composite material 120 combined with the deionizing properties of the gas. In any event, the current limiting device 100 is effective in limiting the short-circuited current so that the other components of the circuit are not harmed by the short circuit.

After the short-circuited current is interrupted, the current limiting device returns or reforms into its nonseparated state due to compressive pressure P which acts to push the separated layers together. Once the layers of the current limiting device have returned to the nonseparated state or the low resistance state, the current limiting device is fully operational for future current-limiting operations in response to other short-circuit events.

Alternate embodiments of the current limiting device can be made by employing a parallel current path containing a resistor, varistor, or other linear or nonlinear elements to achieve goals such as controlling the maximum voltage that may appear across the current limiting device in a particular circuit or to provide an alternative path for some of the circuit energy in order to increase the usable lifetime of the current limiting device.

Figure 2:
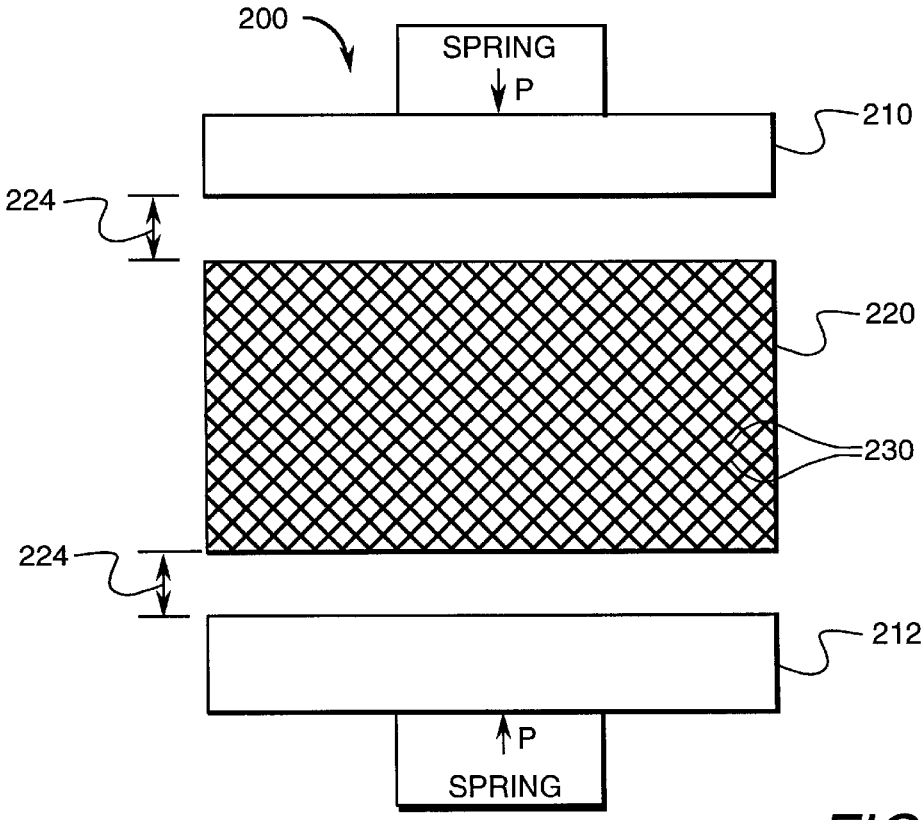
FIG. 2 illustrates a current limiting device according to a second embodiment of the invention.

FIG. 2 illustrates a current limiting device according to another embodiment of the invention. The current limiting device 200 includes first and second electrodes 210, 212 an electrically conductive composite material 220 positioned between the electrodes, and at least one thin layer 224 which is positioned perpendicular to the direction of current flow and has a higher resistance than the average resistance for an average layer of the same thickness and orientation in the device. The thin layer 224 may be, for example, a layer which includes opposing surfaces of one of the electrodes 210, 212 and the composite material 220, wherein the higher resistance derives from the contact resistance between the electrode and composite material. The thin layer 224 may also be formed anywhere between the electrodes, for example as shown in FIG. 4, and by methods other than contact resistance, as discussed above.

The current limiting device 200 is typically under compressive pressure in a direction perpendicular to the selected thin high resistance layer, as indicated by the arrows labeled "P" in FIG. 2. The composite material 220 typically comprises a low pyrolysis temperature binder and conducting filler, examples of which are described below, that is pressure contacted to the electrodes so that there is a contact resistance between the material and one or both electrodes. In operation, the device is placed in series with the electrical circuit to be protected.

As shown in FIG. 2, the current limiting device 200 also includes a reinforcing web 230 which is disposed within the composite material 220. The web 230 typically takes the form of a three-dimensional network of connected, continuous strands. According to this embodiment, the web 230 may extend all the way from one electrode 210 to the other electrode 212, and may be in physical contact with one or both electrodes. The strands of the web typically comprise an electrically insulative material, having a specific resistivity greater than $10^6$ ohm-cm, for example. The strands of the web are typically sufficiently compliant to facilitate or allow reformation of the separated layers after a switching event. The strands of the web 230 may comprise glass, fiberglass, nylon, polyester, graphite fibers, boron fibers, cotton, modified cotton, rayon, cellulose, a cellulose derivative, an acrylic, polycarbonate, polyurethane, or a polyaramid (KEVLAR), for example.

The compliant nature of the web 230 allows the web to yield as the composite material 220 ablates in the selected thin layer 224, e.g. at the interface between the composite material and the electrode, during a switching event. Yielding of the web 230 along with the ablation of the composite material 230 facilitates or allows the current limiting device 200 to return or reform into its nonseparated state due to compressive pressure P which pushes the separated layers (e.g. the composite material and electrode) together. It is believed that once the layers of the current limiting device have returned to the nonseparated state or the low resistance state, the current limiting device is fully operational for future current-limiting operations in response to other short-circuit events.

The web 230 may be generally in the form of a two-dimensional mesh, if desired. In FIG. 2, the size and configuration of the web 230 relative to the size of the composite material 220 is provided as an example, and those skilled in the art will recognize that other configurations are possible. The web 230 provides reinforcement to the composite material 220 to prevent cracking or breaking of the composite material 220 during a switching event, in which a substantial amount of energy is typically directed to the composite material. If enhanced strength is desired, the strands of the web can be formed of a metal such as nickel, aluminum, silver, or copper, for example.

The embodiments shown in FIGS. 1–2 can be formed by impregnating the web with the composite material. For example, according to one embodiment, a web-reinforced current limiting device can be fabricated by placing the desired web or mesh in the same type of mold in which the mesh-free composite material is formed, together with the composite material, and curing the composite material by application of heat and pressure. Molding conditions are of course adjusted appropriately to be compatible with the composition of the web material.

Figure 3:
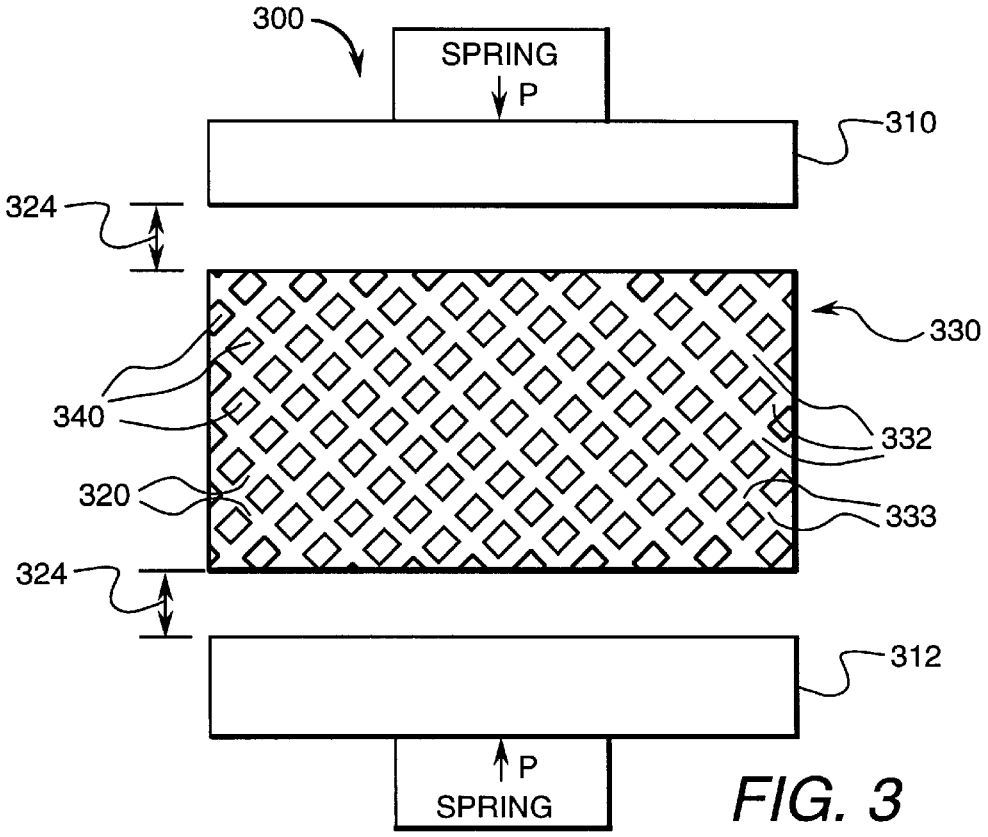
FIG. 3 illustrates a current limiting device according to a third embodiment of the invention which includes a web-shaped composite material.

FIG. 3 illustrates a current limiting device 300 according to a further embodiment of the invention. In FIG. 3, the current limiting device 300 includes first and second electrodes 310, 312 and an electrically conductive composite material 320. According to this embodiment, the composite material 320 itself is in the form of a web 330 having continuously connected strands 332. The strands of the web 330 typically are connected to one another at a plurality of nodes to form a three-dimensional network structure. The network structure may have a regular pore structure between strands.

The current limiting device 300 is formed to have an inhomogeneous distribution of resistance structure. The inhomogeneous distribution of resistance is typically provided by at least one thin layer positioned perpendicular to the direction of current flow which has a higher resistance than the average resistance for an average layer of the same thickness and orientation in the device. The thin layer 324 may be, for example, a layer which includes opposing surfaces of one of the electrodes 310, 312 and the composite material 320, wherein the higher resistance derives from the contact resistance between the electrode and composite material. The thin layer may also be formed anywhere between the electrodes, as shown for example in FIG. 4, and by methods other than contact resistance, as discussed above.

Interspersed between the strands 332 of the web 330 is a compressible material 340 which reduces mechanical stresses on the composite material 320 during a switching event. The compressible material 340 may also have a high thermal conductivity to reduce thermal stresses on the composite material. The compressible material 340 may be a polymer, for example, which is more compressible and has a higher thermal conductivity that the composite material 320. Examples of a suitable compressible material 340 include natural and synthetic rubbery materials, such as a silicone rubber, an elastomer such as silicone (polyorganosiloxane), (poly)urethane, isoprene rubber, and neoprene. The compressible material 340 may also comprise air, for example.

The compressible material 340 typically has a sufficient dielectric strength to prevent an arc from striking directly between the two electrodes 310, 312. In order to prevent an arc, the compressible material 340 is typically in close physical contact with the surrounding composite material 320. The compressible material 340, for example, can be adhered to the surrounding composite material 320. Fillers can be added to the compressible material 340, for example to enhance dielectric strength or thermal conductivity.

Forming the composite material 320 in the shape of a web or mesh permits the composite material to dissipate heat more efficiently and to expand freely into the space occupied by the compressible material 340 adjacent to the composite material 320. Relief of stresses, e.g., mechanical and thermal stresses, caused by high current and voltage, helps to eliminate cracking and shattering of the composite material 320.

The embodiment shown in FIG. 3 can be formed by first forming a solid block of composite material, and then converting the composite material into a web form by cutting out appropriate portions. For example, cavities can be bored in the composite material and filled with the compressible material. Alternatively, the composite material can be molded directly in the form of a web structure. Such a mold contains inserts corresponding to the openings in the web. The openings in the web can be subsequently filled with the compressible material, for example, by placing the web-shaped composite material in a mold, filling the mold with the compressible material, and curing the compressible material at a suitable temperature and pressure. Alternatively, the embodiment of FIG. 3 can be made by forming the compressible material into particles of a suitable size, dispersing the particles in the composite material, and solidifying the composite material around the particles.

Examples of compositions of the composite materials 120, 220, 320 will now be described.

EXAMPLE 1

The electrically conductive composite material comprises an elastomer, specifically silicone, as the binder material and a metal, specifically silver, as the filler material and has a resistivity of about 0.004 ohm-cm. The silver-filled curable silicone material (elastomer) can be made by mixing two parts, A and B. The A part comprises a vinyl silicone organopolysiloxane fluid having terminal dimethylvinylsiloxy units and dimethylsiloxy units with a viscosity of 400 cps at 25° C. (23 g), the following silver particles from Ames Goldsmith Corp., Ag 4300 (46.6 g), Ag 1036 (37.3 g) and Ag 1024 (37.3 g), and a silicone hydride siloxane fluid having terminal trimethyl siloxy units to provide a fluid with about 0.8% by weight chemically combined hydrogen attached to silicon (1 g). The B part comprises the vinyl silicone organopolysiloxane fluid having terminal dimethylvinylsiloxy units and dimethylsiloxy units with a viscosity of 400 cps (2 g), dimethyl maleate (14 $\mu$L) and Karstedt's platinum catalyst (83 $\mu$L of a 5% platinum solution in xylene) [for details see U.S. Pat. No. 3,775,452, B. D. Karstedt (1973)]. The A component (40 g) and B component (0.44 g) are mixed and then poured into a mold and then cured in a Carver press at 150° C., 30 minutes at 5000 pounds pressure.

The electrodes may comprise copper electroplated with nickel and are typically pressure contacted to the composite material. The electrodes are typically about ¼ inch in diameter and are centered on the composite material which has about a ¾ inch diameter and a thickness dimension of about ⅛ inch. Pressure can be applied by placing a force of about 3.7 kg across the electrodes with a pressurizer, e.g. a spring, which results in a pressure of about 170 psi.

EXAMPLE 2

According to this example, the composite material comprises a thermoset binder, specifically an epoxy binder and a metal, specifically nickel powder, as the conducting filler material. This material, which is available as N30 material from Epoxy-Technology, Inc., has a resistivity of about 0.02–0.03 ohm-cm and does not rely on a PTCR effect to limit current. The electrodes may comprise copper electroplated with nickel. Pressure can be applied by placing a force of about 8.2 kg across the electrodes with a pressurizer, resulting in a pressure of about 370 psi.

EXAMPLE 3

According to this example, a thermoset binder, specifically an epoxy binder, with a metal filler, specifically silver, is prepared using the following silver particles from Ames Goldsmith Corp., Ag 4300 (5.6 g), Ag 1036 (4.2 g), Ag 1024 (4.2 g), and a two component commercial epoxy (Epotek 301) obtained from Epoxy Technology Inc. The epoxy resin (2.3 g) is mixed with the hardener (0.6 g) and then the silver particles are added and the mixture is placed in a Teflon® mold and cured at 60° C. for 1 hour. The electrodes can be made of Ni-coated Cu and can be applied with a pressure of about 170 psi, for example.

EXAMPLE 4

An elastomer binder, specifically a silicone binder, with a two-component metal conducting filler, specifically silver and aluminum, as the conducting filler, can be prepared by mixing two parts, A and B. The A part comprises a vinyl silicone organopolysiloxane fluid having terminal dimethylvinylsiloxy units and dimethylsiloxy units (400 cps, 23 g), 37.3 g of aluminum powder, the following silver particles from Ames Goldsmith Corp., Ag 4300 (46.6 g), Ag 1036 (37.3 g), and Ag 1024 (37.3 g), and a silicone hydride siloxane fluid having terminal trimethyl siloxy units to provide a fluid with about 0.8% by weight chemically combined hydrogen attached to silicon (1 g). The B part comprises vinyl silicone organopolysiloxane fluid having terminal dimethylvinylsiloxy units and dimethylsiloxy units with a viscosity of 400 cps (2 g), dimethyl maleate (14 $\mu$L) and Karstedt's platinum catalyst, mentioned above (83 $\mu$L of a 5% platinum solution in xylene). The A component (40 g) and B component (0.44 g) are mixed and then poured into a mold and then cured in a Carver press at about 150° C. for about 30 minutes at about 5000 pounds pressure. The electrodes can be made of either Ni-coated Cu or an n-type Si (semiconductor), for example, and applied to the composite material with a pressure of about 170 psi.

EXAMPLE 5

A reinforced elastomer binder, specifically a curable silicone reinforced with fumed silica, with a two component metal filler, specifically silver and aluminum, can be made with an A part and a B part. The A part is composed of an elastomer binder, specifically a vinyl silicone organopolysiloxane fluid having terminal dimethylvinylsiloxy units and dimethylsiloxy units (400 cps, 23 g), a silicone hydride siloxane fluid having terminal trimethyl siloxy units to provide a fluid with about 0.8% by weight chemically combined hydrogen attached to silicon (2 g), doubly treated fumed silica (300 $m^2/g$, treated with cyclo-octamethyltetrasiloxane and with hexamethyldisilazane, 1.2 g), aluminum powder (37.3 g), silver particles from Ames Goldsmith Corp., Ag 4300 (46.6 g), Ag 1036 (37.3 g), Ag 1024 (37.3 g). The B part is composed of the vinyl silicone organopolysiloxane fluid having terminal dimethylvinylsiloxy units and dimethylsiloxy units (400 cps, 2 g), dimethylmaleate (14 $\mu$L) and Karstedt's platinum catalyst (83 $\mu$L). A curable formulation can be prepared by combining the A part (40 g) and the B part (0.44 g) and then hand mixing and placing in a mold. Cure can be accomplished in a Carver press at 5000 pounds pressure and 150° C. for 30 min. The electrodes can be made of Ni-coated Cu and applied to the composite material with a pressure of about 6 psi, for example.

EXAMPLE 6

A thermoplastic binder, specifically Poly(ethylene glycol), with a metal filler, specifically silver, as the conducting filler can be made. A silver particle mixture comprising the following particles from Ames Goldsmith Corp., Ag 4300 (2.8 g), Ag 1036 (2.1 g), Ag 1024 (2.1 g) is heated to about 80° C. and then poured into molten Poly (ethyleneglycol) (MW8000) at about 80° C. and mixed. The material is then poured into a Teflon® mold and allowed to harden at room temperature. The electrodes can be made of Ni-coated Cu and applied to the composite material with a pressure of about 6 psi, for example.

EXAMPLE 7

According to this example, the composite material comprises a polymeric matrix material and a conductive filler. The polymeric matrix material comprises at least one epoxy and at least one silicone. The epoxy for the polymeric matrix material is selected from the group comprising condensation products of epichlorohydrin and bisphenol-A (Epon 828 Shell), an epoxy-functionalized silicone monomer, for example DMSE01 (Gelest Inc.), Araldite DT025 (CIBA), butyl glycidyl ether (epoxy), and other suitable epoxy materials.

The epoxy component typically comprises about 10–90% by weight of the polymeric matrix material. The silicone for the polymeric matrix material is selected from the group consisting of epoxy-functionalized silicone monomer, for example DMSE01 (Gelest Inc.), dimethylsiloxane, poly [(methyl)(aminoethylaminopropyl)siloxane (PMAS), and Aminosilicone (Magnasoft ULTRA from WITCO Corp.), and is provided in a range of about 10–80% by weight of the polymeric matrix material.

The conductive filler material is typically selected from the group comprising nickel powder, silver, and carbon black. The conductive filler material comprises about 50% to about 90% by weight of the total composite material, with the polymeric matrix material comprising the remainder of the composite material.

The composite material exhibits good thermal and structural stability at temperatures greater than 100° C. The composite material is mechanically robust and structurally stable to withstand repeated high current states. The mechanical robustness of the composite material is believed to be due, at least in part, to the incorporation of silicone into the polymeric matrix, which provides bonds that are able to withstand large forces. The resistance stability of the composite material after repeated high current events is believed to be partially due to chemical bonds derived from epoxy groups. This and other suitable composite materials are described in commonly-owned U.S. Ser. No. 09/081,888, which is hereby incorporated by reference.

EXAMPLE 8

According to this example, the composite material comprises an organic binder and a conductive filler. The organic binder comprises a high Tg epoxy, a low viscosity polyglycol epoxy, and at least one curing agent. The high Tg epoxy is typically provided in a range of at least 70% by weight of the organic binder. The high Tg epoxy may comprise, for example, novolac or a bisphenol A structure. The low viscosity polyglycol epoxy typically comprises up to about 30% by weight of the organic binder. One example of a low viscosity polyglycol epoxy is DER 736, available from Dow Chemical Corp. The low viscosity polyglycol epoxy provides flexibility to the high Tg epoxy. The curing agent of the organic binder may comprise a conventional curing agent for an epoxy such as an acid, amine, anhydride, or a free radical initiator. One example of a curing agent is a boron trichloride amine complex, DY9577, available from Ciba Geigy Corp. The curing agent may be provided in an amount of about 2–10% of the combined mass of the high Tg epoxy and low viscosity polyglycol epoxy.

The conductive filler may comprise, for example, a fine nickel powder such as Ni 255 air classified fines Ni powder, available from Novamet Corp. The conductive filler typically comprises about 55–70% by weight of the composite material, and the organic binder typically comprises about 45–30% by weight of the composite material. This and other suitable composite materials are described in commonly-owned U.S. Ser. No. 08/896,874, which is hereby incorporated by reference.

EXAMPLE 9

The composite material comprises a conductive filler material and at least one organic binder. The organic binder typically comprises at least one thermoplastic polymer matrix. The polymer of the polymer matrix is typically made from at least one cyclic thermoplastic oligomer. Examples of suitable cyclic oligomers include cyclic polycarbonates (see U.S. Pat. No. 4,727,134), cyclic polyesters (see U.S. Pat. No. 5,039,783), and cyclic polyamides (see U.S. Pat. No. 5,362,845). The composite material can be made, for example, by dry blending the cyclic oligomer with a suitable polymerization initiator and a conductive filler. The dry blending provides for a uniform dispersion of the conductive filler, e.g. nickel, in the cyclic oligomer and conductive filler mixture. The dry-blending is then followed by application of heat and pressure to consolidate the composite material and polymerize the cyclic oligomer. Since there is typically no flow of the material while under pressure, the uniform dispersion of the conductive filler in the cyclic oligomer is maintained.

The composite material can also be formed by solution blending a cyclic oligomer with an initiator and conductive filler; or melting the cyclic oligomer to a low viscosity melt and mixing the oligomer with the conductive filler and an initiator.

Thermoplastic polymers provide mechanical robustness to the composite material. Thermoplastic polymers also provide enhanced softening and flow at elevated temperatures, which can be advantageous in regaining a low resistance state after the ablation of a switching event. The enhanced flow, for example, is believed to provide an increase in effective contact area as the current limiting device regains its low resistance state. This and other suitable composite materials are described in commonly-owned U.S. Ser. No. 08/977,672, which is hereby incorporated by reference.

Other examples of binder materials having a low pyrolysis or vaporization temperature, e.g. <800° C., include a thermoplastic, for example, polytetrafluoroethylene, poly (ethyleneglycol), polyethylene, polycarbonate, polyimide, polyamide, polymethylmethacrylate, polyester, liquid crystal polyester, polypropylene, poly(phenylene sulfide), etc.; a thermoset plastic, for example, epoxy, polyester, polyurethane, phenolic, alkyd; an elastomer, for example, silicone (polyorganosiloxane), (poly)urethane, isoprene rubber, neoprene, etc.; an organic or inorganic crystal. Other examples of electrically conducting fillers include nickel, silver, copper, carbon black, titanium dioxide, titanium boride, carbon, and graphite.

Third phase fillers can be used to improve specific properties of the composite such as the mechanical or dielectric properties, or to provide arc-quenching properties or flame-retardant properties. Materials which could be used as a third phase filler in the composite material include: a filler selected from reinforcing fillers such as fumed silica, or extending fillers such as precipitated silica and mixtures thereof. Other fillers include titanium dioxide, lithopone, zinc oxide, diatomaceous silicate, silica aerogel, iron oxide, diatomaceous earth, calcium carbonate, silazane treated silicas, silicone treated silicas, glass fibers, magnesium oxide, chromic oxide, zirconium oxide, alpha-quartz, calcined clay, carbon, graphite, cork, cotton sodium bicarbonate, boric acid, alumina-hydrate, etc. Other additives may include: impact modifiers for preventing damage to the current limiter such as cracking upon sudden impact; flame retardant for preventing flame formation and/or inhibiting flame formation in the current limiter; dyes and colorants for providing specific color components in response to customer requirements; UV screens for preventing reduction in component physical properties due to exposure to sunlight or other forms of UV radiation.

Finally, the current limiter of the present invention can be utilized with one or more parallel linear or nonlinear circuit elements such as resistors or varistors.

Other embodiments of the invention will be apparent to those skilled in the art from a consideration of this specification or practice of the invention disclosed herein. It is intended that the specification and examples be considered as exemplary only, with the true scope and spirit of the invention being defined by the following claims.

What is claimed is:

1. A current limiting device comprising:

first and second electrodes;

a composite material between the first and second electrodes, the composite material comprising: (a) a binder, and (b) an electrically conductive filler;

a thin layer which provides an inhomogeneous distribution of resistance to the device and which increases its resistance to limit current by thermal expansion and gas evolution from the binder;

a web which reinforces the composite material; and a pressurizer for pressing the electrodes against the composite material and allowing the electrodes to separate from the composite material when the thermal expansion and gas evolution occurs;

wherein the web is disposed in an inner volume of the composite material which does not include the thin layer, and the web has no contact with the first or second electrode.

2. The device of claim 1, wherein the thin layer includes opposing faces of the first electrode and the composite material, and the inhomogeneous distribution of resistance is derived from a contact resistance between the first electrode and the composite material.

3. The device of claim 1, wherein the composite material is formed in two halves, the thin layer includes opposing faces of the two halves, and the inhomogeneous distribution of resistance is derived from a contact resistance between the two halves.

4. The device of claim 1, wherein the pressurizer comprises a spring.

5. The device of claim 1, wherein the web comprises a metal.

6. The device of claim 1, wherein the web comprises at least one of nickel, aluminum, silver, and copper.

7. The device of claim 1, wherein the web comprises at least one of: glass, fiberglass, nylon, polyester, graphite fiber, boron fiber, cotton, rayon, cellulose, acrylic, polycarbonate, polyurethane, and polyaramid.

8. The device of claim 1, wherein the binder has a pyrolysis or vaporization temperature, at which gas evolution occurs, of less than 800° C.

9. The device of claim 8, wherein the inhomogeneous distribution of resistance causes resistive heating and rapid thermal expansion and vaporization of the binder during a short circuit.

10. The device of claim 1, wherein the web comprises a three-dimensional network of connected, continuous strands.

11. The device of claim 10, wherein the strands are connected at nodes to form a network structure.

12. The device of claim 1, wherein the web is in the form of a two-dimensional mesh.

13. The current limiting device of claim 1, wherein the thin layer comprises a surface of the composite material and a surface of one of the electrodes.

14. The current limiting device of claim 1, wherein the binder comprises at least one of: silicone and epoxy, and the electrically conductive filler comprises at least one of: silver, nickel, aluminum, titanium boride, graphite, and carbon black.

15. The current limiting device of claim 1, wherein the composite material comprises a first portion having a first surface and a second portion having a second surface, and the thin layer includes the first surface and the second surface.

16. A current limiting device comprising:

first and second electrodes;

a composite material between the first and second electrodes, the composite material comprising: (a) a binder, and (b) an electrically conductive filler;

a web disposed in an inner volume of the composite material, the web being formed of an electrically insulative material;

a thin layer which provides an inhomogeneous distribution of resistance to the device, wherein the resistance of the thin layer increases by thermal expansion and gas evolution from the binder in response to a short circuit current passing through the thin layer; and a pressurizer for pressing the electrodes against the composite material and allowing the electrodes to separate from the composite material when the thermal expansion and gas evolution occurs.

17. The device of claim 16, wherein the web comprises at least one of: glass, fiberglass, nylon, polyester, graphite fiber, boron fiber, cotton, rayon, cellulose, acrylic, polycarbonate, polyurethane, and polyaramid.

18. The device of claim 16, wherein strands of the web are sufficiently compliant to allow the pressurizer to force the composite material into contact with the first electrode after a switching event.

19. The current limiting device of claim 16, wherein the thin layer comprises a surface of the composite material and a surface of one of the electrodes.

20. The current limiting device of claim 16, further comprising a second thin layer, wherein the web extends from the thin layer to the second thin layer.

21. The current limiting device of claim 16, wherein the web extends from the first electrode to the second electrode.

22. The current liming device of claim 16, wherein the web is disposed throughout the inner volume of the composite material.

23. The current limiting device of claim 16, wherein the binder comprises at least one of: silicone and epoxy, and the electrically conductive filler comprises at least one of: silver, nickel, aluminum, titanium boride, graphite, and carbon black.

24. The current limiting device of claim 16, wherein the composite material comprises a first portion having a first surface and a second portion having a second surface, and the thin layer includes the first surface and the second surface.

25. A current limiting device comprising:

first and second electrodes;

a composite material between the first and second electrodes, the composite material being in the form of a web, the composite material comprising: (a) a binder, and (b) an electrically conductive filler;

a compressible material which occupies spaces within the web; and a pressurizer for pressing the electrodes against the composite material, wherein the pressurizer comprises a spring.

26. The device of claim 25, wherein the web comprises a network of connected strands of the composite material.

27. The device of claim 26, wherein the compressible material comprises at least one of: silicone, polyurethane, isoprene rubber, and neoprene.

28. The current limiting device of claim 25, wherein the compressible material comprises a solid.

29. The current limiting device of claim 25, wherein the first and second electrodes have a surface which is greater than an opposing surface of the web.

30. The current limiting device of claim 25, wherein the spring retracts during a current limiting event as separation occurs at the thin layer.

31. The current limiting device of claim 25, wherein the binder comprises at least one of: silicone and epoxy, and the electrically conductive filler comprises at least one of: silver, nickel, aluminum, titanium boride, graphite, and carbon black.

* * * * *